US010784581B2

(12) United States Patent
Kakuya et al.

(10) Patent No.: US 10,784,581 B2
(45) Date of Patent: Sep. 22, 2020

(54) ANTENNA DEVICE

(71) Applicant: DENSO CORPORATION, Kariya, Aichi-pref. (JP)

(72) Inventors: Yuuji Kakuya, Nisshin (JP); Tsutomu Goto, Nisshin (JP); Hiroaki Kuraoka, Kariya (JP); Shiro Koide, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 16/099,768

(22) PCT Filed: Apr. 27, 2017

(86) PCT No.: PCT/JP2017/016672
§ 371 (c)(1),
(2) Date: Nov. 8, 2018

(87) PCT Pub. No.: WO2107/199722
PCT Pub. Date: Nov. 23, 2017

(65) Prior Publication Data

US 2019/0181558 A1 Jun. 13, 2019

(30) Foreign Application Priority Data

May 17, 2016 (JP) ..... 2016-098991

(51) Int. Cl.
*H01Q 9/04* (2006.01)
*H01Q 1/48* (2006.01)
*H01Q 13/08* (2006.01)

(52) U.S. Cl.
CPC ..... *H01Q 9/0421* (2013.01); *H01Q 1/48* (2013.01); *H01Q 13/08* (2013.01)

(58) Field of Classification Search
CPC ..... H01Q 9/0421; H01Q 1/48; H01Q 13/08
See application file for complete search history.

(56) References Cited

U.S. PATENT DOCUMENTS 7,230,572 B2 6/2007 Aisenbrey
7,911,386 B1 3/2011 Itoh et al.
(Continued)

FOREIGN PATENT DOCUMENTS

JP 2004236289 A 8/2004
JP 2007504768 A 3/2007
(Continued)

*Primary Examiner* — Hai V Tran
*Assistant Examiner* — Michael M Bouizza
(74) *Attorney, Agent, or Firm* — Harness, Dickey & Pierce, P.L.C.

(57) ABSTRACT

An antenna device includes a ground part, a patch part disposed parallel to the ground part to oppose the ground part, a short-circuit part electrically connecting the patch part and the ground part, a patch area expansion part and a ground area expansion part. The patch area expansion part is provided on a patch-side opposing surface that is a surface of the patch part opposing the ground part to expand an effective surface area that is an apparent area of the patch-side opposing surface with respect to the ground part. The ground area expansion part is provided in a region opposing the patch area expansion part on a ground-side opposing surface that is a surface of the ground part opposing the patch part to expand an effective surface area of the ground-side opposing surface with respect to the patch part.

15 Claims, 4 Drawing Sheets

(56) References Cited

U.S. PATENT DOCUMENTS

| | | | | |
|---|---|---|---|---|
| 2005/0078050 | A1* | 4/2005 | Aisenbrey ..... | H01Q 1/36<br>343/895 |
| 2005/0116867 | A1 | 6/2005 | Park et al. | |
| 2010/0214178 | A1 | 8/2010 | Toyao et al. | |
| 2014/0091879 | A1 | 4/2014 | Toyao et al. | |
| 2014/0152520 | A1 | 6/2014 | Toyao et al. | |

FOREIGN PATENT DOCUMENTS

| | | | |
|---|---|---|---|
| JP | 5326649 | B2 | 10/2013 |
| JP | 2013226865 | A | 11/2013 |

* cited by examiner

ANTENNA DEVICE

CROSS REFERENCE TO RELATED APPLICATIONS

This application is a U.S. National Phase Application under 35 U.S.C. 371 of International Application No. PCT/JP2017/016672 filed on Apr. 27, 2017. This application is based on and claims the benefit of priority from Japanese Patent Application No. 2016-098991 filed on May 17, 2016. The entire disclosures of all of the above applications are incorporated herein by reference.

TECHNICAL FIELD

The present disclosure relates to an antenna device having a flat plate structure.

BACKGROUND ART

Conventionally, as disclosed in Patent Literature 1, there is an antenna device equipped with a metal conductor having a plate shape that provides a ground electric potential by being connected with a power supply line (hereinafter, ground part), a metal conductor having a plate shape disposed to oppose the ground plate and on which a power supply point is provided at any position (hereinafter, patch part), and a short-circuit part that electrically connects the ground part and the patch part.

The antenna device disclosed in Patent Literature 1 generates parallel resonance by a capacitance formed between the ground part and the patch part, and an inductance equipped in the short-circuit part. The inductance can be adjusted by the length and the shape of the short-circuit part, and an electrostatic capacity formed between the patch part and the ground part is determined depending on the area of the patch part and the distance between the patch part and the ground plate (hereinafter, distance between opposed conductors).

Accordingly, the antenna device having the above-mentioned structure enables to obtain desired frequency for a frequency that is target of transmission and reception (hereinafter, operating frequency) in the antenna device by adjusting the separation between the patch part and the ground plate and the area of the patch part.

PRIOR ART LITERATURE

Patent Literature

Patent Literature 1: U.S. Pat. No. 7,911,386 B1

SUMMARY OF INVENTION

The antenna device is desired to be further downsized. One approach to downsize the antenna device employing the operating principle disclosed in Patent Literature 1 is a method that reduces the area of the patch part as well as cancels a decrease in the capacitance generated due to the area reduction by increasing the inductance. The inductance can be provided by, for example, lengthening the short-circuit part, or connecting one end of a linear conductor to the short-circuit part.

However, when the capacitance included in the antenna device is reduced and the inductance included therein is increased, Q value indicating sharpness of the peak of resonance becomes large, robustness as the antenna device is lowered. This is because Q value becomes larger as the inductance becomes larger and the capacitance becomes smaller as shown in the following formula. R denotes a pure resistance value, L denotes the inductance, and C denotes the capacitance in the formula.

$$Q = \frac{1}{R}\sqrt{\frac{L}{C}} \quad \text{[Formula 1]}$$

It is an object of the present disclosure to provide an antenna device capable of being downsized while suppressing increase of Q value.

According to a first aspect of the present disclosure, an antenna device includes a ground part, a patch part, a short-circuit part, a patch area expansion part and a ground area expansion part. The ground part is a conductive member having a plate shape. The patch part is a conductive member having a plate shape disposed parallel to the ground part to oppose the ground part. The short-circuit part is a conductive member electrically connecting the patch part and the ground part.

The patch area expansion part is provided on a patch-side opposing surface that is a surface of the patch part opposing the ground part. The patch area expansion part expands an effective surface area that is an apparent area of the patch-side opposing surface with respect to the ground part. The ground area expansion part is provided in a region opposing the patch area expansion part on a ground-side opposing surface that is a surface of the ground part opposing the patch part. The ground area expansion part expands an effective surface area of the ground-side opposing surface with respect to the patch part.

The effective surface area of the patch-side opposing surface expanded by the patch area expansion part is equal to an area for providing a necessary capacitance that is a capacitance necessary to generate parallel resonance with an inductance provided by the short-circuit part at a predetermined operating frequency.

According to the first aspect of the present disclosure, by being provided with the patch area expansion part on the patch-side opposing surface, an apparent area of the patch-side opposing surface with respect to the ground part (that is, effective surface area) is expanded. In addition, by being provided with the ground area expansion part on the ground-side opposing surface, an effective surface area of the ground-side opposing surface with respect to the patch part is expanded. That is, a capacitance greater than a capacitance corresponding to an original area equipped in the patch part is formed.

Accordingly, when operating frequency is fixed, the first aspect of the present disclosure makes it possible to reduce the size of the patch part as compared with a conventional structure. Herein, the conventional structure denotes a structure where conductive fiber layers are not provided on each of the patch-side opposing surface and the ground-side opposing surface.

According to the first aspect of the present disclosure, an inductance need not be increased for downsizing. Accordingly, the first aspect makes it possible to downsize the antenna device while suppressing increase of Q value.

According to a second aspect of the present disclosure, an antenna device includes a ground-side conductive fiber part, a patch-side conductive fiber part and a short-circuit part. The ground-side conductive fiber part is a plate member having conductive fibers that are fibers having conductivity.

The patch-side conductive fiber part is a plate member having the conductive fibers. The patch-side conductive fiber part is disposed parallel to the ground-side conductive fiber part to oppose the ground-side conductive fiber part. The short-circuit part is a conductive member electrically connecting the patch-side conductive fiber part and the ground-side conductive fiber part.

A size of the patch-side conductive fiber part is equal to a size for providing a necessary capacitance that is a capacitance necessary to generate parallel resonance with an inductance provided by the short-circuit part at a predetermined operating frequency.

In the antenna device according to the second aspect of the present disclosure, a capacitance greater than a capacitance corresponding to an actual area of the patch-side conductive fiber part in top view is also formed due to the same operating principle as that of the antenna device according to the first aspect of the present disclosure described above. Therefore, the second aspect of the present disclosure provides the same advantageous effect as that of the first aspect of the present disclosure.

BRIEF DESCRIPTION OF DRAWINGS

The above and other objects, features and advantages of the present disclosure will become more apparent from the following detailed description made with reference to the accompanying drawings, in which.

DESCRIPTION OF EMBODIMENTS

First Embodiment

Figure 1:
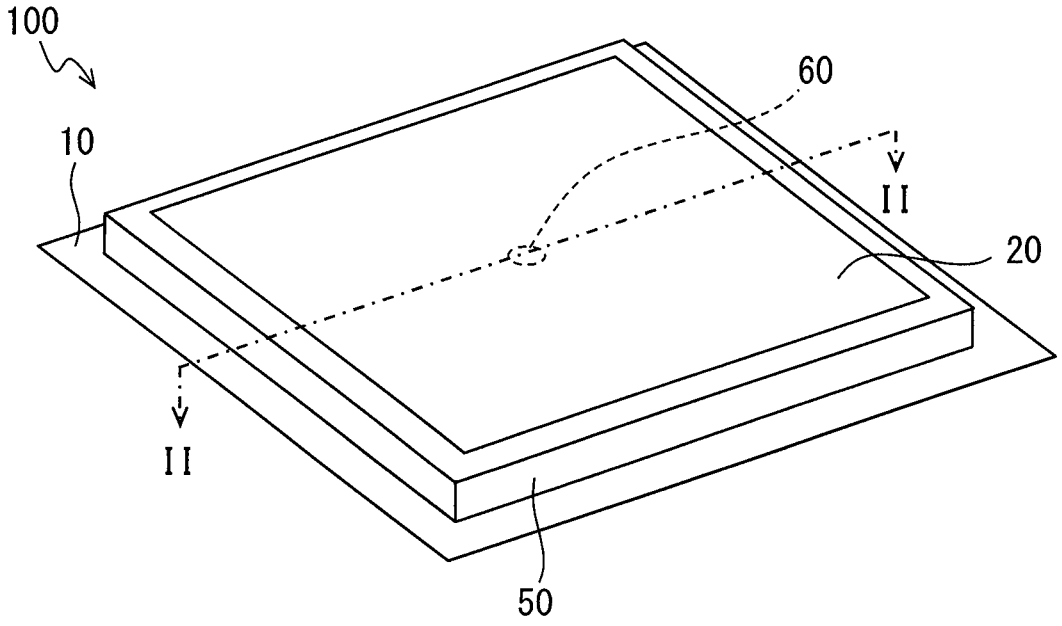
FIG. 1 is a schematic exterior perspective view of an antenna device.
Figure 2:
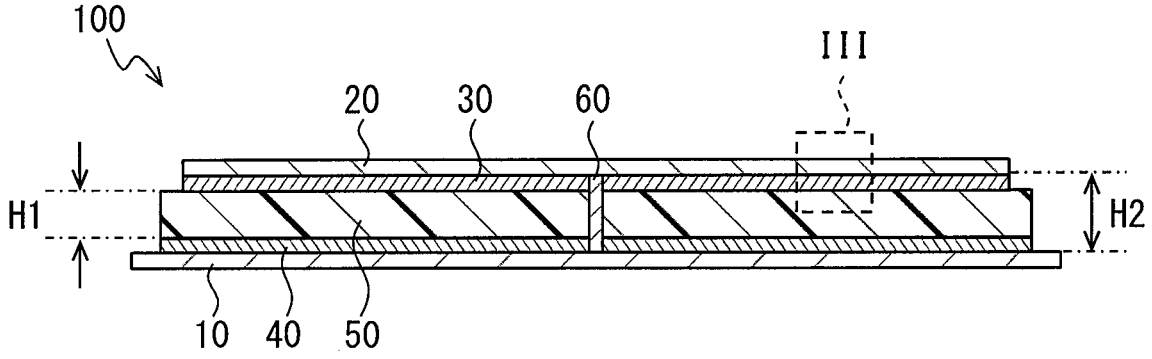
FIG. 2 is a cross sectional view of the antenna device along the line II-II illustrated in FIG. 1.

Hereinafter, a first embodiment of the present disclosure will be described using the drawings. FIG. 1 is an exterior perspective view illustrating an example of a schematic structure of an antenna device 100 according to the present embodiment. FIG. 2 is a cross sectional view of the antenna device 100 along the line II-II illustrated in FIG. 1.

The antenna device 100 is configured to transmit and receive a radio wave having a predetermined operating frequency. Of course, as another mode, the antenna device 100 may be used for only either one of transmission and reception.

Herein, the operating frequency shall be 5.9 GHz as an example. Of course, the operating frequency is enough to be appropriately designed, and for example, it may be 300 MHz, 760 MHz, 900 MHz, or the like as another mode. The antenna device 100 can transmit and receive a radio wave having not only the operating frequency but also a frequency within a predetermined range around the operating frequency. For convenience, a frequency band that enables the antenna device 100 to perform transmission and reception will be hereinafter also described as operating band.

The antenna device 100 is connected to a radio via, for example, a coaxial cable, and a signal received by the antenna device 100 is sequentially output to the radio. The antenna device 100 converts an electric signal input from the radio into a radio wave and radiates it in a space. The radio uses the signal received by the antenna device 100 as well as supplies to the antenna device 100 high frequency power depending on a transmission signal.

In the present embodiment, description is made on the assumption that the antenna device 100 and the radio is connected by the coaxial cable, but another known communication cable such as a feeder line may be used for connection. The antenna device 100 and the radio may be connected via a known matching circuit, a filter circuit, or the like besides the coaxial cable.

Hereinafter, a specific structure of the antenna device 100 will be described. The antenna device 100 includes, as illustrated in FIGS. 1 and 2, a ground part 10, a patch part 20, a patch-side conductive fiber layer 30, a ground-side conductive fiber layer 40, a supporting part 50, and a short-circuit part 60.

The ground part 10 is a conductive member having a plate shape (including a foil) whose material is a conductor such as copper. The ground part 10 is electrically connected to an external conductor that is the coaxial cable and provides a ground electrical potential (in other words, earth potential) in the antenna device 100. Note that, it is sufficient that the ground part 10 is larger than the patch part 20, and that the shape in its top view (hereinafter, planar shape) is appropriately designed.

Herein, as an example, the planar shape of the ground part 10 shall be a square shape, but the planar shape of the ground part 10 may be a rectangular shape or another polygonal shape as another mode. Alternatively, it may be a circular (including ellipse) shape. Of course, it may be a shape combining a straight line part and a curved line part.

The patch part 20 is a conductive member having a plate shape whose material is a conductor such as copper. The patch part 20 is disposed to oppose the ground part 10 via the patch-side conductive fiber layer 30, the ground-side conductive fiber layer 40, and the supporting part 50. Herein, as an example, the planar shape of the patch part 20 shall be a square shape, but it may be a rectangular shape or another shape other than a rectangular shape (e.g., a circular shape, an octagon shape, or the like).

The patch-side conductive fiber layer 30 is a layer of conductive fiber (hereinafter, conductive fiber layer). The patch-side conductive fiber layer 30 is provided on a surface on a side opposing the ground part 10 in the patch part 20 (hereinafter, patch-side opposing surface). Note that, as an example in the present embodiment, the patch-side conductive fiber layer 30 shall be provided in the entire region of the patch-side opposing surface except the portion where the short-circuit part 60 is provided.

Figure 3:
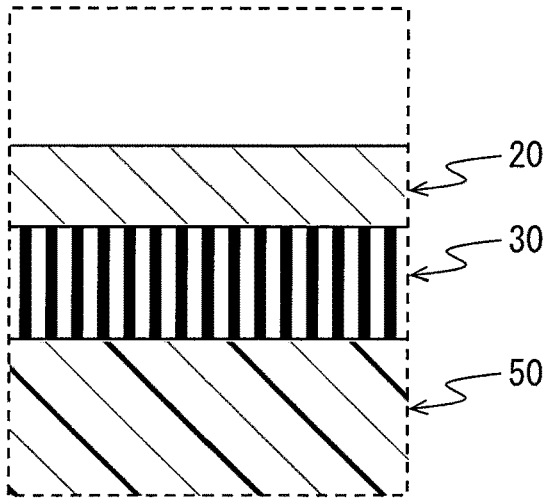
FIG. 3 is an enlarged view of a portion surrounded by sign III illustrated in FIG. 2.

FIG. 3 is an enlarged view of the region surrounded by a broken line of FIG. 2, and illustrates a schematic structure of the patch-side conductive fiber layer 30. As illustrated in FIG. 3, the patch-side conductive fiber layer 30 in the present embodiment shall be formed such that fibers having conductive property (hereinafter, conductive fibers) erect with respect to the patch-side opposing surface. The erection herein is not limited to perfect erection, and includes a mode in which the angle with respect to the patch-side opposing surface is inclined in a rage of greater than a predetermined angle (e.g., 60 degrees). In other words, in the patch-side conductive fiber layer 30, the conductive fibers are extended toward the ground part 10 from the patch-side opposing surface.

Although omitted in the drawing, a dielectric substance having a predetermined dielectric constant is filled in each gap between the conductive fibers. As the conductive fiber, a known element can be employed such as carbon nanotube or silver nanowire. Herein, the conductive fiber providing the conductive fiber layer shall be a silver nanowire as an example. The patch-side conductive fiber layer 30 corresponds to a patch area expansion part due to the reason described below.

The ground-side conductive fiber layer 40 is also a conductive fiber layer, and its specific structure is the same as that of the patch-side conductive fiber layer 30. The ground-side conductive fiber layer 40 is provided on a surface on a side opposing the patch part 20 in the ground part 10 (hereinafter, ground-side opposing surface). It is sufficient that the ground-side conductive fiber layer 40 is provided at a portion opposing the patch-side conductive fiber layer 30 on the ground-side opposing surface. That is, in the ground-side conductive fiber layer 40, the conductive fiber is extended toward the patch part 20 from the ground-side opposing surface. The ground-side conductive fiber layer 40 corresponds to a ground area expansion part.

Hereinafter, when the patch part 20 and the patch-side conductive fiber layer 30 are collectively denoted, they are described as a patch-side unit for convenience. In addition, when the ground part 10 and the ground-side conductive fiber layer 40 are collectively denoted, they are described as a ground-side unit for convenience. By being oppositely disposed, the patch-side unit and the ground-side unit function as a capacitor for providing a capacitance corresponding to the area of the patch-side unit.

The supporting part 50 is a member for disposing the ground-side unit and the patch-side unit to be oppositely disposed with a predetermined distance. It is sufficient that the supporting part 50 be provided by using a dielectric substance such as a resin.

In the present embodiment, the supporting part 50 shall be a member having a plate shape having a thickness of H1. Adjustment of the thickness H1 of the supporting part 50 makes it possible to adjust a distance H2 between opposed conductors as a separation between the patch part 20 and the ground part 10. This is because the value obtained by adding the thicknesses of the respective conductive fiber layers to the thickness H1 corresponds to the distance H2 between opposed conductors.

The distance H2 between opposed conductors functions as an element for adjusting the length of the short-circuit part 60, in other words, the inductance provided by the short-circuit part 60 as described below. Furthermore, the distance H2 between opposed conductors also functions as an element for adjusting the capacitance formed by the ground-side unit and the patch-side unit opposed.

It is sufficient that the distance H1 is sufficiently smaller than the wavelength of the radio wave of the operating frequency (hereinafter, target wavelength), and that its specific value is appropriately determined by a simulation or an experiment. The distance H1 is preferably at least not more than one tenth of the target wavelength. For example, it is sufficient that the distance H1 be one fiftieth, one hundredth, or the like of the target wavelength.

It is sufficient that the supporting part 50 play the above-described role, and that the shape of the supporting part 50 be appropriately designed. For example, the supporting part 50 may be a plate member that supports the ground part 10 and the patch part 20 so as to be opposed with the predetermined distance H1, or may be a plurality of pillars.

In addition, in the present embodiment, the structure is employed in which the resin (that is, supporting part 50) is filled between the ground-side unit and the patch-side unit as an example, but the structure is not limited thereto. The space between the ground-side unit and the patch-side unit may be a hollow, or a plurality of types of dielectric substances may be laminated in the space. In addition, the structures exemplified above may be combined.

The short-circuit part 60 is conductive and electrically connects the patch part 20 and the ground part 10. It is sufficient that the short-circuit part 60 is provided by using a conductive pin (hereinafter, short pin). Adjustment of the length or the like of the short pin as the short-circuit part 60 makes it possible to adjust the inductance equipped in the short-circuit part 60.

Note that, when the antenna device 100 is provided by using a print wiring board as a base, a via provided on the print wiring board may be made to function as the short-circuit part 60. In any case, the short-circuit part 60 is a linear member electrically connected with the ground part 10 at its one end and electrically connected with the patch part 20 at the other end. Note that, electrical connection with the patch part 20 also includes electromagnetic connection described below as a third modification.

The short-circuit part 60 is provided at a position that becomes the center of the patch part 20 in the top view (hereinafter, patch center point). It is sufficient that the patch center point is a point corresponding to the gravity center of the patch part 20. Since the patch part 20 of the present embodiment has a square shape, the patch center point corresponds to the intersection point of the diagonal lines of the square.

Note that the short-circuit part 60 is not necessarily arranged at the patch center point. Arrangement at a position other than the patch center point generates deviation of directivity depending on deviation amount from the patch center point. In the range where the deviation of directivity is included in a predetermined acceptable range, the short-circuit part 60 may be disposed at a position deviated from the patch center point.

Functions of Conductive Fiber Layer

The various conductive fiber layers have a surface area of greater than a plane area because of assemble of conductive fiber. The plane area herein is an area in the top view. For example, when number density of the silver nanowire is $10^9$ [number/$cm^2$], wire radius thereof is 20 [nm], and wire length thereof (in other words, thickness of conductive fiber layer) is 32 [μm], the surface area per 1 [$cm^2$] becomes 40 [$cm^2$].

The ground-side conductive fiber layer 40 and the patch-side conductive fiber layer 30 are respectively disposed on the ground part 10 and the patch part 20 to be opposed with each other. This expands an apparent area of the patch-side opposing surface with respect to the ground part 10 (hereinafter, effective surface area) due to the principle similar to that of electrolytic capacitor.

That is, by introducing the ground-side conductive fiber layer 40 and the patch-side conductive fiber layer 30, as compared with the structure where no conductive fiber layer is included as a conventional structure, the capacitance per a unit area provided by the patch-side unit can be increased. The effective surface area is a notion corresponding to electrode area in the field of electrolytic capacitor.

In other words, the conductive fiber layers provided on each of the patch-side opposing surface and the ground-side opposing surface so as to be opposed to each other function as members for expanding the area of the patch part 20 that contributes to formation of capacitance (that is, effective surface area) so as to be a value larger than the actual area of the patch part 20.

Therefore, the above structure makes it possible to provide a capacitance larger than the capacitance corresponding to the area intrinsically equipped in the patch part 20. Accordingly, when the operating frequency is made constant, the area of the patch part 20 can be reduced as compared with the conventional one.

Furthermore, downsizing of the antenna device by the above structure is achieved by increasing the capacitance per unit area provided by the patch-side unit. That is, according to the above structure, the inductance component need not be increased. Accordingly, the antenna device 100 can be downsized without increasing Q value indicating sharpness of peak of the operating band.

Note that the capacitance provided by disposing the patch-side unit so as to oppose the ground-side unit is necessary to have a magnitude that allows parallel resonance with the inductance formed by the short-circuit part 60 in the operating frequency. The capacitance per unit area provided by disposing the patch-side unit to oppose the ground-side unit (hereinafter, unit capacitance) can be changed also by the separation H1. It is sufficient that the unit capacitance depending on the separation H1 is specified by measurement by an experiment or the like. Using the unit capacitance depending on the separation H1 makes it possible to determine the area that should be equipped in the patch part 20.

It is sufficient that the size or the like of each part equipped in the above-mentioned antenna device 100 is designed by, for example, the following procedure. First, the length of the short-circuit part 60 originated from the separation H1 is determined depending on the height allowable as the antenna device 100. This determines the inductance provided by the short-circuit part 60.

Next, the capacitance that should be provided by the patch-side unit is determined based on the inductance provide by the short-circuit part 60 and the operating frequency. Then, the planer shape and the size (in other words, area) of the patch part 20 are determined based on the capacitance that should be formed by the patch-side unit and the unit capacitance depending on the separation H1.

Note that when the antenna device 100 is manufactured, it is sufficient that the ground-side conductive fiber layer 40, the supporting part 50, the patch-side conductive fiber layer 30, the patch part 20, and the like are sequentially formed on the ground part 10. It is sufficient that the short-circuit part 60 is disposed in the middle of the processes or after the processes.

It is sufficient that a power feeding point is provided at an appropriately designed position, for example, a position at which impedance matching can be obtained. Power feeding method may be a direct coupling power feeding method or may be an electromagnetic coupling power feeding method. The direct coupling power feeding method includes a mode where a short pin as the short-circuit part 60 is directly connected to an external conductor that is a coaxial cable, and a mode where the short pin is indirectly connected via a predetermined impedance matching circuit.

The antenna device 100 described above can be used for, for example, a moving body such as a vehicle. When the antenna device 100 is used for a vehicle, it is sufficient that the antenna device 100 is set such that the ground part 10 is substantially horizontal and the direction toward patch part 20 from the ground part 10 substantially matches the zenith direction on a roof part of the vehicle.

Although the embodiment of the present disclosure is described hereinabove, the present disclosure is not limited to the embodiment.

Following modifications may be included in the technical scope of the present disclosure, and the present disclosure may be changed in various other ways other than the following modifications without departing from the gist of the present disclosure.

Members having the same functions as the members described in the above embodiment will be denoted by the same reference numerals, and descriptions thereof will be omitted. Further, when only a partial configuration is described, the configuration of the above-described embodiment may be applied to the other portions.

First Modification

Figure 4:
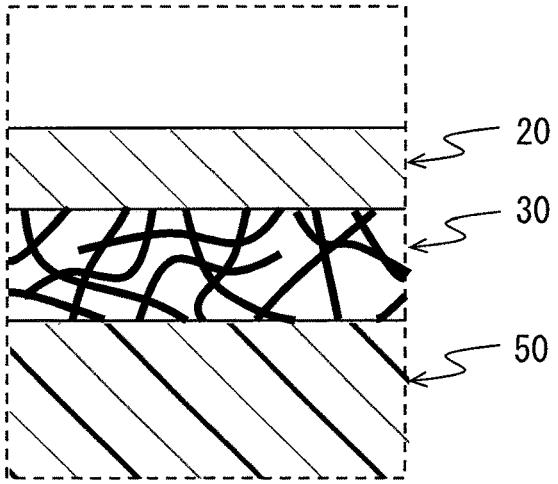
FIG. 4 is a diagram illustrating a modification of a fiber direction of a conductive fiber equipped in a conductive fiber layer.

In the first embodiment described above, the mode is exemplified in which the patch-side conductive fiber layer 30 is formed such that its conductive fibers erect with respect to the patch-side opposing surface, but this is not limited thereto. For example, as illustrated in FIG. 4, orientations of the conductive fibers with respect to the patch-side opposing surface may be random (in other words, irregular). In addition, in this case, a dielectric substance having a predetermined dielectric constant shall be filled in each of gaps between the conductive fibers.

Second Modification

In the above, the mode is exemplified in which the area that contributes to formation of the capacitance (hereinafter, effective area) is expanded by providing the conductive fiber layer on each of the ground-side opposing surface and the patch-side opposing surface, but this is not limited thereto.

Figure 5:
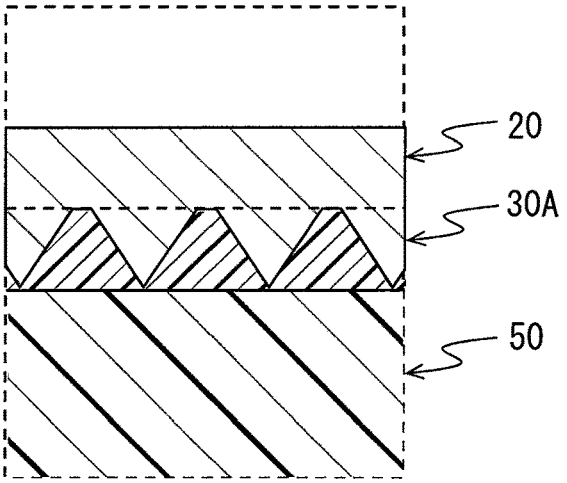
FIG. 5 is a diagram illustrating a modification of a patch area expansion part.

For example, by providing an asperity part 30A with respect to the ground-side opposing surface and the patch-side opposing surface as illustrated in FIG. 5, the effective area may be expanded. Such a mode also provides the same effect as that of the above-mentioned embodiment. The asperity part 30A provided on the patch-side opposing surface corresponds to the patch area expansion part, and the asperity part 30A provided on the ground-side opposing surface corresponds to the ground area expansion part.

The asperity part 30A can be provided by, for example, subjecting the ground-side opposing surface and the patch-side opposing surface to etching or the like. The concrete shape of the asperity part 30A may be any shape in a range providing the above-mentioned effect, and for example, may be a cone shape such as a triangular pyramid shape or a four-sided pyramid shape, or may be a frustum shape. Like the conductive fiber layer, a dielectric substance having a predetermined dielectric constant (e.g. resin) shall be filled in a gap of each of asperities equipped in the asperity part 30A.

Third Modification

Figure 6:
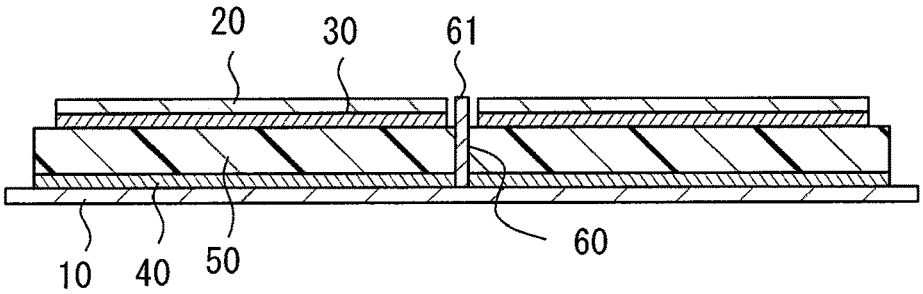
FIG. 6 is a diagram illustrating a schematic structure of an antenna device according to a third modification.

In the above, the mode is disclosed in which the short-circuit part 60 and the patch part 20 are directly connected, but this is not limited thereto. For example, as illustrated in FIG. 6, a predetermined separation may be provided between the short-circuit part 60 and the patch part 20 to be electromagnetically joined with each other. That is, among the ends equipped in the short-circuit part 60, the end 61 on which the patch part 20 exists (hereinafter, patch-side end) may be an open end. The separation between the patch-side end 61 and the patch part 20 is preferably a sufficiently small value with respect to the target wavelength. For example, the separation between the patch-side end 61 and the patch part 20 shall be one hundredth of the target wavelength.

Fourth Modification

Figure 7:
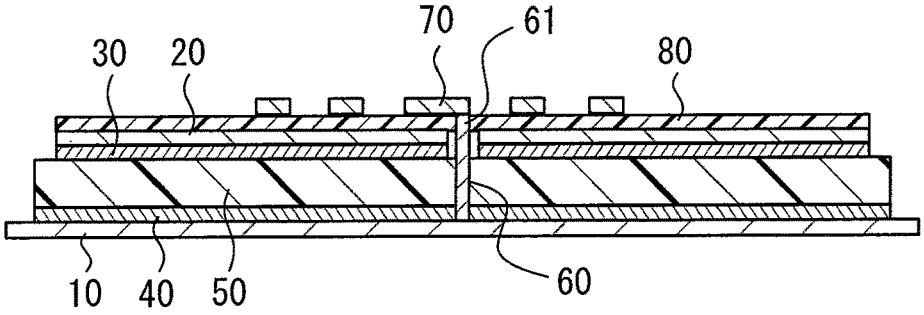
FIG. 7 is a diagram illustrating a schematic structure of an antenna device according to a fourth modification.
Figure 8:
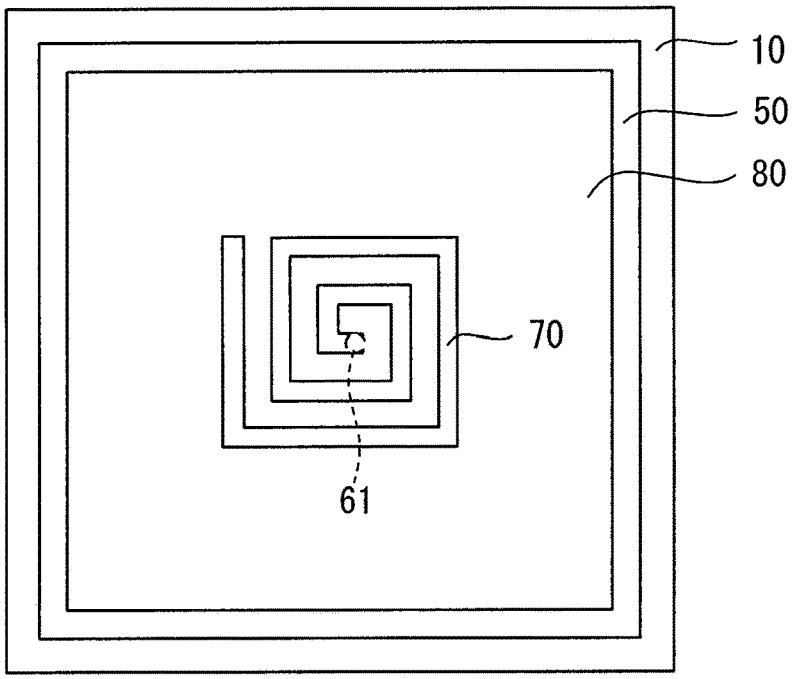
FIG. 8 is a diagram illustrating a schematic structure of the antenna device according to the fourth modification.

In the third modification described above, the patch-side end 61 may be electrically connected to one end of a linear pattern 70 that is conductive and formed in a plane parallel to the patch part 20 as illustrated in FIGS. 7 and 8.

FIG. 7 is a cross sectional view corresponding to FIG. 2 of the antenna device 100 according to a fourth modification, and FIG. 8 is a schematic top view of the antenna device 100. It should be noted here that the size of each part in FIG. 8 does not perfectly match that of FIG. 7 for convenience.

It is sufficient that the linear pattern 70 is provided on, for example, a resin layer 80 laminated on an upper side surface of the patch part 20. Herein, the upper direction is a direction toward patch part 20 from the ground part 10. The upper side surface of the patch part 20 is a surface that is not opposed to the ground-side opposing surface. An end that is not connected to the patch-side end 61 among ends equipped in the linear pattern 70 shall be an open end. As another mode, the linear pattern 70 need not necessarily be a spiral shape as illustrated in FIG. 8, and may be a straight line. Alternatively, it may be a curved line.

Fifth Modification

In the first embodiment described above, the mode is exemplified in which the patch-side conductive fiber layer 30 is provided on the entire area of the patch-side opposing surface, but this is not limited thereto. A mode may be employed in which the patch-side conductive fiber layer 30 is provided on only a part of the patch-side opposing surface. For convenience, a region on which the patch-side conductive fiber layer 30 is provided in the patch-side opposing surface is described as an effective surface area expansion part.

In this case, the effective surface area expansion part shall be provided so as to provide a part of a capacitance necessary for generating parallel resonance with the inductance provided by the short-circuit part 60 in the operating frequency (hereinafter, necessary capacitance).

Furthermore, it is sufficient that an area of the part where no effective surface area expansion part is provided on the patch-side opposing surface has an area providing a capacitance that compensates deficiency of the capacitance provided by the effective surface area expansion part with respect to the necessary capacitance.

The mode in which the conductive fiber layer is provided on only a part of the patch-side opposing surface in this manner also makes it possible to downsize the antenna device 100 while suppressing increase of Q value.

Sixth Modification

Figure 9:
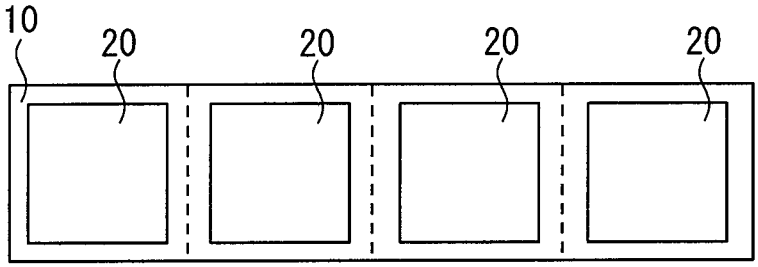
FIG. 9 is a diagram illustrating a mode where the antenna devices are periodically disposed in single dimensional manner.
Figure 10:
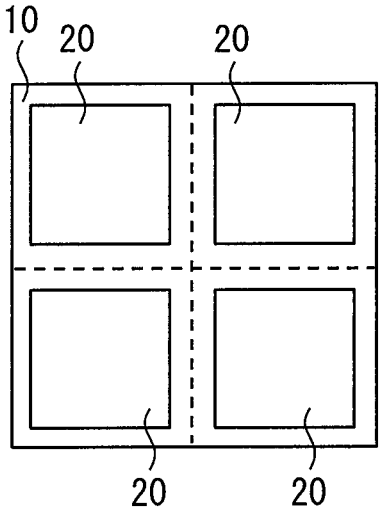
FIG. 10 is a diagram illustrating a mode where the antenna devices are periodically disposed in two dimensional manner.

Using the antenna device 100 described above as one unit structure, a plurality of the unit structures may be periodically disposed in one dimension as illustrated in FIG. 9. In addition, as illustrated in FIG. 10, a plurality of the unit structures may be periodically disposed in two dimensions. Note that the supporting part 50 and the like are omitted in FIGS. 9 and 10. A broken line in FIGS. 9 and 10 denotes a cut line (in other words, a border line) of the unit structures.

The structures in which the unit structures illustrated in FIGS. 9 and 10 are periodically disposed are known as an electromagnetic band gap (EGB) structure. In other words, the structures disclosed in FIGS. 9 and 10 can be provided by using a known method of providing the EGB structure.

Second Embodiment

In the first embodiment described above, the mode is disclosed in which the ground part 10 and the patch part 20 are included in addition to the conductive fiber layers opposed to each other, but this is not limited thereto. The conductive fiber layers opposed to each other may be treated as members corresponding to the ground part 10 and the patch part 20. In other words, no ground part 10 and no patch part 20 may be included. Hereinafter, a schematic structure of an antenna device 200 according to a second embodiment as such a mode will be described using FIG. 11.

Figure 11:
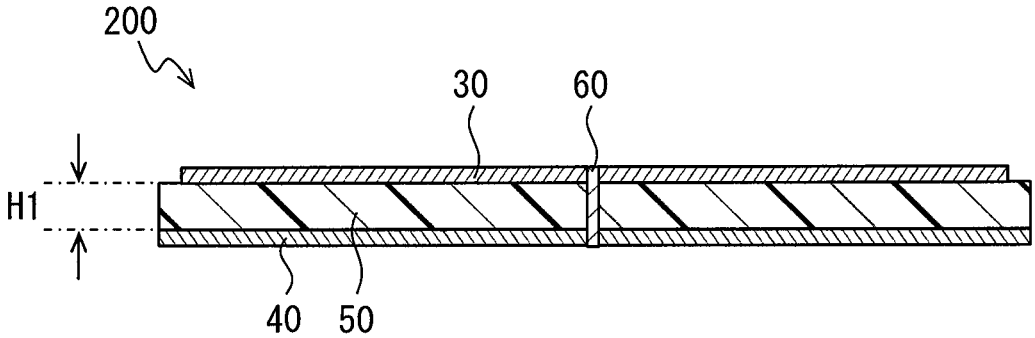
FIG. 11 is a diagram illustrating a schematic structure of an antenna device according to a second embodiment.

FIG. 11 is a diagram corresponding to FIG. 2, and is a cross sectional view of the antenna device 200. The antenna device 200 includes, as illustrated in FIG. 11, a ground-side conductive fiber layer 40 also serves the function as the ground part 10, a patch-side conductive fiber layer 30 also serves the function as the patch part 20, a supporting part 50, and a short-circuit part 60.

The supporting part 50 in the second embodiment supports the ground-side conductive fiber layer 40 and the patch-side conductive fiber layer 30 to be opposed with a predetermined distance H1. The short-circuit part 60 electrically connects the ground-side conductive fiber layer 40 and the patch-side conductive fiber layer 30. Such a structure also makes it possible to achieve the same effect as that of the first embodiment. The patch-side conductive fiber layer 30 in the second embodiment corresponds to a patch-side conductive fiber part and the ground-side conductive fiber layer 40 therein corresponds to a ground-side conductive fiber part.

The idea disclosed as various modifications with respect to the first embodiment disclosed above can be also applied to the second embodiment. For example, the end of the short-circuit part 60 on which the patch-side conductive fiber layer 30 exists (that is, patch-side end 61) may be an open end. In addition, the linear pattern 70 may be connected to the patch-side end 61. In addition, as disclosed as the sixth modification, using the antenna device 200 as a unit structure, a plurality of the unit structures may be periodically disposed in one dimension or two dimensions.

Although the present disclosure is described based on the above embodiments, the present disclosure is not limited to the embodiments and the structures. Various changes and modification may be made in the present disclosure. Furthermore, various combination and formation, and other combination and formation including one, more than one or less than one element may be made in the present disclosure.

What is claimed is:

1. An antenna device comprising:

a ground part that is a conductive member having a plate shape;

a patch part that is a conductive member having a plate shape disposed parallel to the ground part to oppose the ground part;

a short-circuit part that is a conductive member electrically connecting the patch part and the ground part;

a patch area expansion part that is provided on a patch-side opposing surface that is a surface of the patch part opposing the ground part, the patch area expansion part expanding an effective surface area that is an apparent area of the patch-side opposing surface with respect to the ground part; and a ground area expansion part that is provided in a region opposing the patch area expansion part on a ground-side opposing surface that is a surface of the ground part opposing the patch part, the ground area expansion part expanding an effective surface area of the ground-side opposing surface with respect to the patch part, wherein;

the effective surface area of the patch-side opposing surface expanded by the patch area expansion part is equal to an area for providing a necessary capacitance that is a capacitance necessary to generate parallel resonance with an inductance provided by the short-circuit part at a predetermined operating frequency; and each of the patch area expansion part and the ground area expansion part is a conductive fiber layer having conductive fibers, or an asperity part provided on the patch-side opposing surface and the ground-side opposing surface.

2. The antenna device according to claim 1, wherein each of the patch area expansion part and the ground area expansion part is the conductive fiber layer.

3. The antenna device according to claim 2, wherein the conductive fiber layer has a dielectric substance having a predetermined dielectric constant and filled in gaps between the conductive fibers.

4. The antenna device according to claim 2, wherein:

the conductive fibers of the conductive fiber layer as the patch area expansion part extend toward the ground part from the patch-side opposing surface; and the conductive fibers of the conductive fiber layer as the ground area expansion part extend toward the patch part from the ground-side opposing surface.

5. The antenna device according to claim 2, wherein:

orientations of the conductive fibers with respect to the patch part are irregular in the conductive fiber layer as the patch area expansion part; and orientations of the conductive fibers with respect to the ground part are irregular in the conductive fiber layer as the ground area expansion part.

6. The antenna device according to claim 1, further comprising a linear pattern that is a linear conductive member disposed above the patch part, wherein:

the short-circuit part has a patch-side end that is an end adjacent to the patch part and electromagnetically connected to the patch part;

the patch-side end is connected to one end of the linear pattern; and another end of the linear pattern that is not connected to the patch-side end is an open end.

7. The antenna device according to claim 1, wherein a distance between the patch area expansion part and the ground area expansion part is equal to or less than one tenth of a wavelength of a radio wave at the predetermined operating frequency.

8. The antenna device according to claim 1, further comprising a supporting part made of a dielectric filled between the patch area expansion part and the ground area expansion part, wherein a distance between the patch area expansion part and the ground area expansion part is equal to or less than one hundredth of a wavelength of a radio wave at the predetermined operating frequency.

9. The antenna device according to claim 1, wherein the short-circuit part is provided at the center of the patch part.

10. An antenna device comprising:

a ground-side conductive fiber part that is a plate member having conductive fibers;

a patch-side conductive fiber part that is a plate member having the conductive fibers, the patch-side conductive fiber part being disposed parallel to the ground-side conductive fiber part to oppose the ground-side conductive fiber part; and a short-circuit part that is a conductive member electrically connecting the patch-side conductive fiber part and the ground-side conductive fiber part, wherein a size of the patch-side conductive fiber part is equal to a size for providing a necessary capacitance that is a capacitance necessary to generate parallel resonance with an inductance provided by the short-circuit part at a predetermined operating frequency.

11. The antenna device according to claim 10, further comprising a linear pattern that is a linear conductive member disposed above the patch-side conductive fiber part, wherein:

the short-circuit part has a patch-side end that is an end adjacent to the patch-side conductive fiber part and electromagnetically connected to the patch-side conductive fiber part;

the patch-side end is connected to one end of the linear pattern; and another end of the linear pattern that is not connected to the patch-side end is an open end.

12. The antenna device according to claim 10, wherein:

orientations of the conductive fibers with respect to the ground-side conductive fiber part are irregular in the patch-side conductive fiber part; and orientations of the conductive fibers with respect to the patch-side conductive fiber part are irregular in the ground-side conductive fiber part.

13. The antenna device according to claim 10, wherein a distance between the ground-side conductive fiber part and the patch-side conductive fiber part is equal to or less than one tenth of a wavelength of a radio wave at the predetermined operating frequency.

14. The antenna device according to claim 10, further comprising a supporting part made of a dielectric filled between the ground-side conductive fiber part and the patch-side conductive fiber part, wherein a distance between the ground-side conductive fiber part and the patch-side conductive fiber part is equal to or less than one hundredth of a wavelength of a radio wave at the predetermined operating frequency.

15. The antenna device according to claim 10, further comprising the short-circuit part is provided at the center of the patch-side conductive fiber part.

* * * * *